US006260224B1

(12) United States Patent
Pinkus

(10) Patent No.: US 6,260,224 B1
(45) Date of Patent: Jul. 17, 2001

(54) MATERIAL COLLECTOR HAVING ELECTRICAL POWER SUPPLIES AND ELECTRICAL CONDUCTORS

(76) Inventor: Michael R. Pinkus, 3350 Hardscrabble Rd., North Minnetrista, MN (US) 55364

( * ) Notice: Subject to any disclaimer, the term of this patent is extended or adjusted under 35 U.S.C. 154(b) by 0 days.

(21) Appl. No.: 09/129,001

(22) Filed: Aug. 4, 1998

Related U.S. Application Data

(60) Provisional application No. 60/054,666, filed on Aug. 4, 1997.

(51) Int. Cl.[7] ..... B08B 13/00; H05F 3/00

(52) U.S. Cl. ..... 15/1.52; 96/66; 96/96; 361/212; 361/213; 361/216; 361/220; 361/221; 361/222; 361/225; 361/226; 361/229; 361/230; 361/231; 361/234

(58) Field of Search ..... 15/1.51, 1.52, 15/339; 361/212, 213, 216, 220, 221, 222, 230, 231, 233, 234, 225, 226, 229; 96/66, 96

(56) References Cited

U.S. PATENT DOCUMENTS 2,426,315 * 8/1947 Marick ..... 15/1.52
4,083,073 * 4/1978 Bernardini ..... 15/1.52
4,095,303 * 6/1978 Armstrong et al. ..... 15/1.51
4,128,909 * 12/1978 Kawabe et al. ..... 15/1.52
4,255,776 * 3/1981 Cantelli ..... 15/1.52
5,125,124 * 6/1992 Saeki et al. ..... 15/1.51
5,957,090 * 9/1999 Larson ..... 15/1.52

FOREIGN PATENT DOCUMENTS

2490110 * 3/1982 (FR) .
3-204565 * 9/1991 (JP) .
5-285084 * 11/1993 (JP) .
1409347 * 7/1988 (SU) .

* cited by examiner

*Primary Examiner*—Jill Warden

(57) ABSTRACT

A broom type particle collector has a particle pick-up assembly joined to an elongated handle. The pick-up assembly has a non-electrical conductive foam plastic member accommodating a cathode for imparting negative charges or particles and an anode for collecting the charged particles. An electrical power supply located within the handle provides electric power to the cathode and anode.

13 Claims, 5 Drawing Sheets

MATERIAL COLLECTOR HAVING ELECTRICAL POWER SUPPLIES AND ELECTRICAL CONDUCTORS

CROSS REFERENCE TO RELATED APPLICATION

This application is a continuation of U.S. provisional application Ser. No. 60/054,666 filed Aug. 4, 1997.

FIELD OF THE INVENTION

The invention is in the field of particle collectors that have electrical conductors and electric power supplies that utilize electrical charges to collect particles, such as dust, dirt, aerosols, bacteria, viruses, pollens, mold spores, animal dander, dust mites, allergens, and particulate matter.

BACKGROUND OF THE INVENTION

Dirty, polluted and unhealthy surfaces and air can cause illness, respiratory irritation and offensive odors. In the past cleaning utensils, such as brooms, and electric vacuums and dusters, have been used to clean floors and other surfaces. Electric air purification systems used to remove airborne pollutants and allergens typically have one or more conventional filtering devices. A fan moves air through the filters and discharges filtered air into the environment.

SUMMARY OF THE INVENTION

The invention relates to an apparatus for collecting particles from air, a surface or object by ionizing or negatively charging the particles with a cathode and collecting the charged particles with an anode. An embodiment of the apparatus has a particle pick-up assembly joined to an elongated handle. The handle is used to facilitate manual movement of the particle pick-up assembly and accommodate the electrical power supply for the pick-up assembly. The pick-up assembly has a non-electrical conductive member accommodating the cathode and anode. The cathode includes a conductor bar and a plurality of laterally spaced fingers attached to the bar. The anode has a rod located within the non-electrical conductive member and spaced from the fingers. Activation of the power supply causes the cathode to impart negative electric charges on the particles as the particle pick-up assembly is moved over the surface or object. The anode having a positive electric charge collects the negatively charged particles on and within the non-electrical conductive member.

DESCRIPTION OF AN EMBODIMENT OF THE INVENTION

Figure 1:
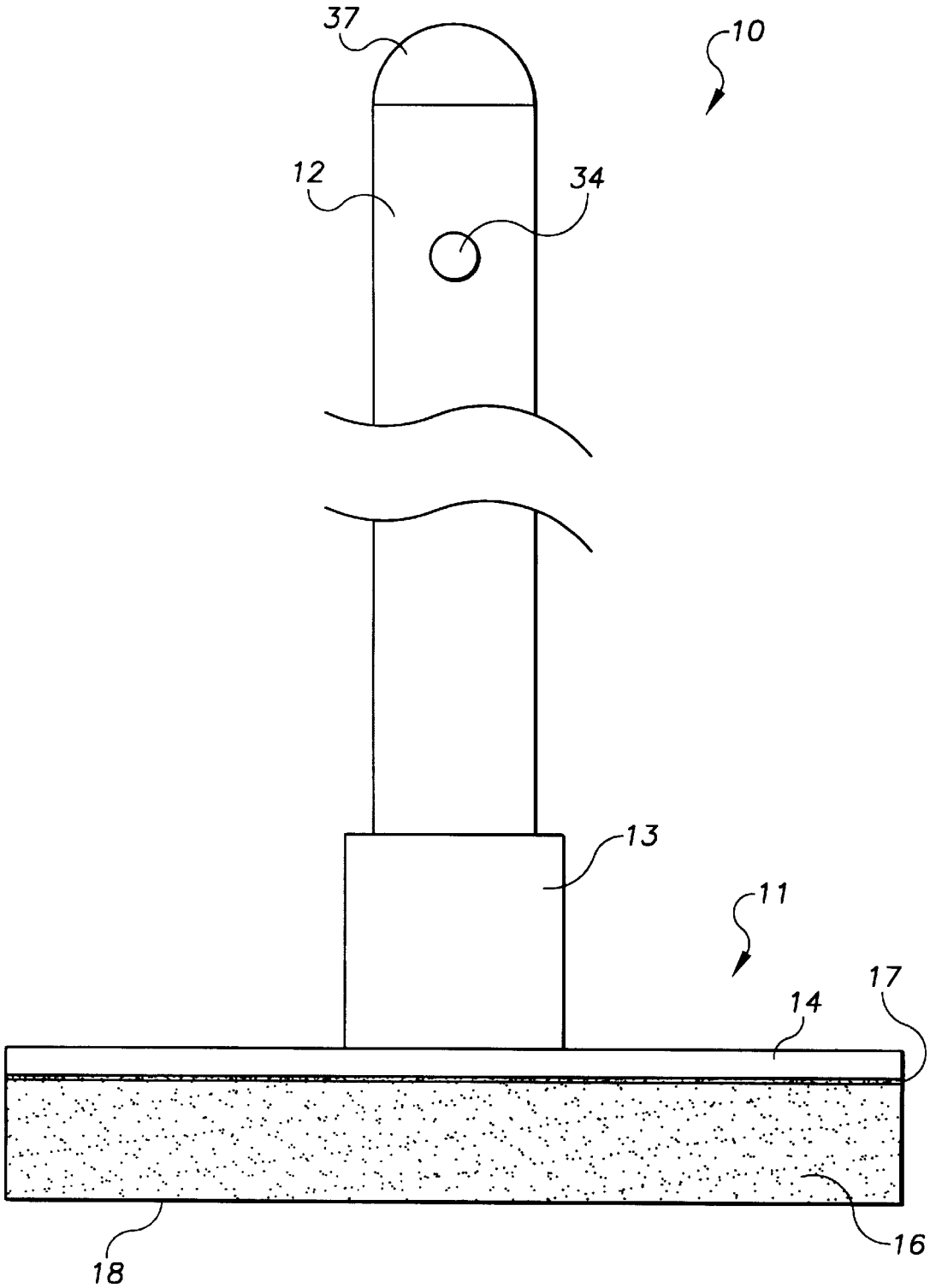
FIG. 1 is a front elevational view of the particle collector of the invention.
Figure 2:
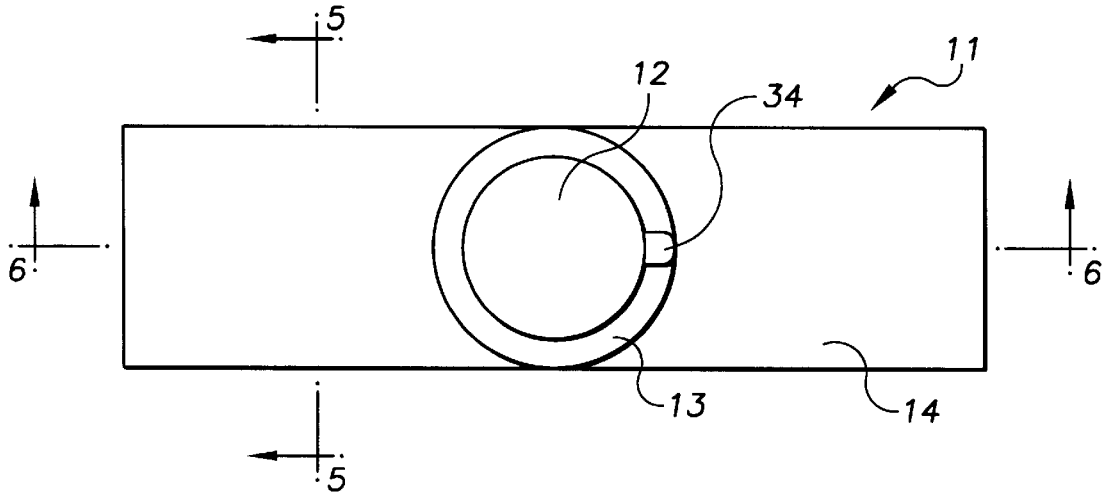
FIG. 2 is a top plan view thereof.
Figure 3:
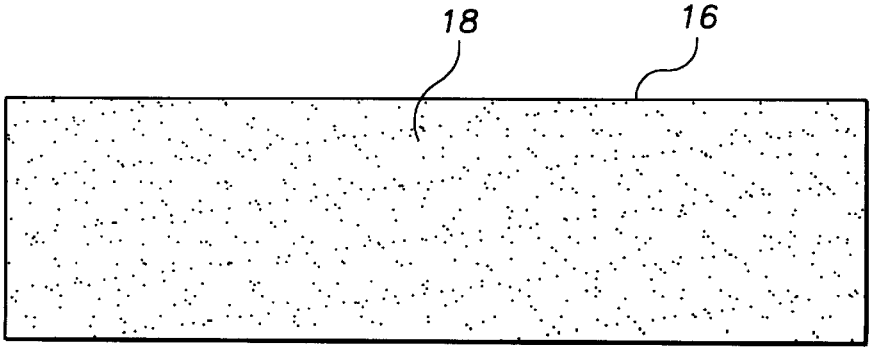
FIG. 3 is a bottom plan view thereof.
Figure 4:
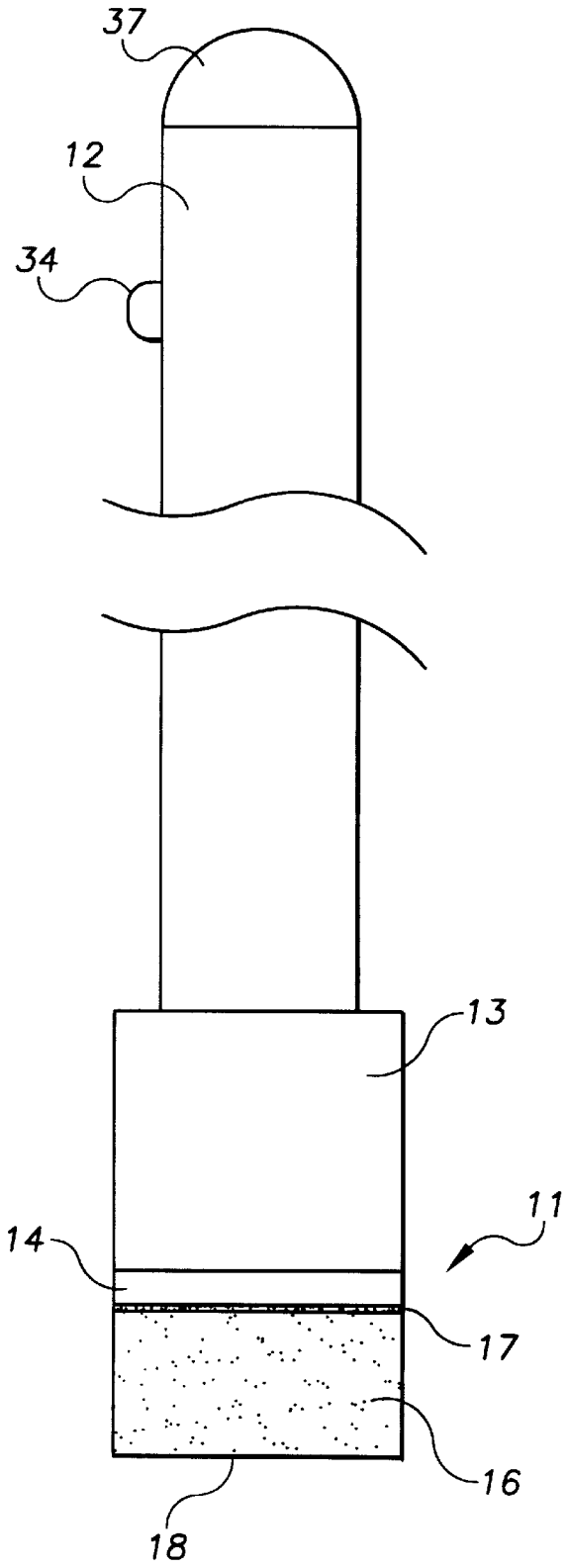
FIG. 4 is a side elevational view thereof.

The collector 10, shown in FIGS. 1 to 4, is a particle collecting device used as a broom to electrostatically pick up particles, such as dust, dirt, grit, aerosols, bacteria, viruses, pollens, mold spores, animal dander, dust mites, allergens, and organic materials, from surfaces, articles and objects. Collector 10 has a particle pick-up assembly 11 joined to a handle 12. Assembly has an upright collar 13 having threads that accommodate the adjacent end of handle 12. Handle 12 can be removed from collar 13 by turning the handle 12 relative to collar 13 in one direction and attached to the collar 13 by turning the handle 12 in the direction opposite the one direction. Different size and shapes of handles can be attached to collar 13.

Pick-up assembly 11 has a cross head 14 joined to collar 13. Gussets joined to collar 13 and head 14 can be used to reinforce collar 13. Cross head 14 has a flat bottom surface secured to a bar member 16 with a layer of adhesive 17. Other types of fastening structures can be used to secure bar member 16 to cross head 14. Bar member 16 is a non-electrical conductive foam plastic having a generally rectangular cross section. The bottom surface 18 of bar member 16 is generally flat. Surface 18 can have different shapes and contours, such as semi-circular or grooved.

Figure 5:
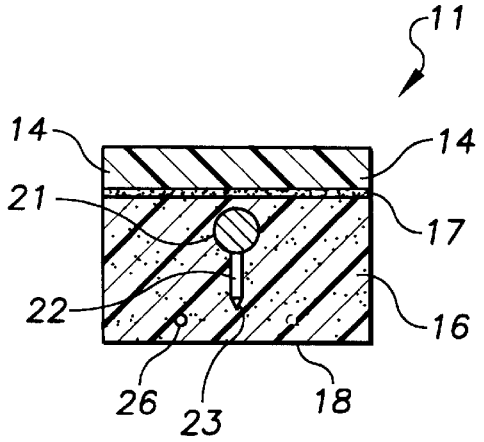
FIG. 5 is a sectional view taken along the line 5—5 of FIG. 2.
Figure 7:
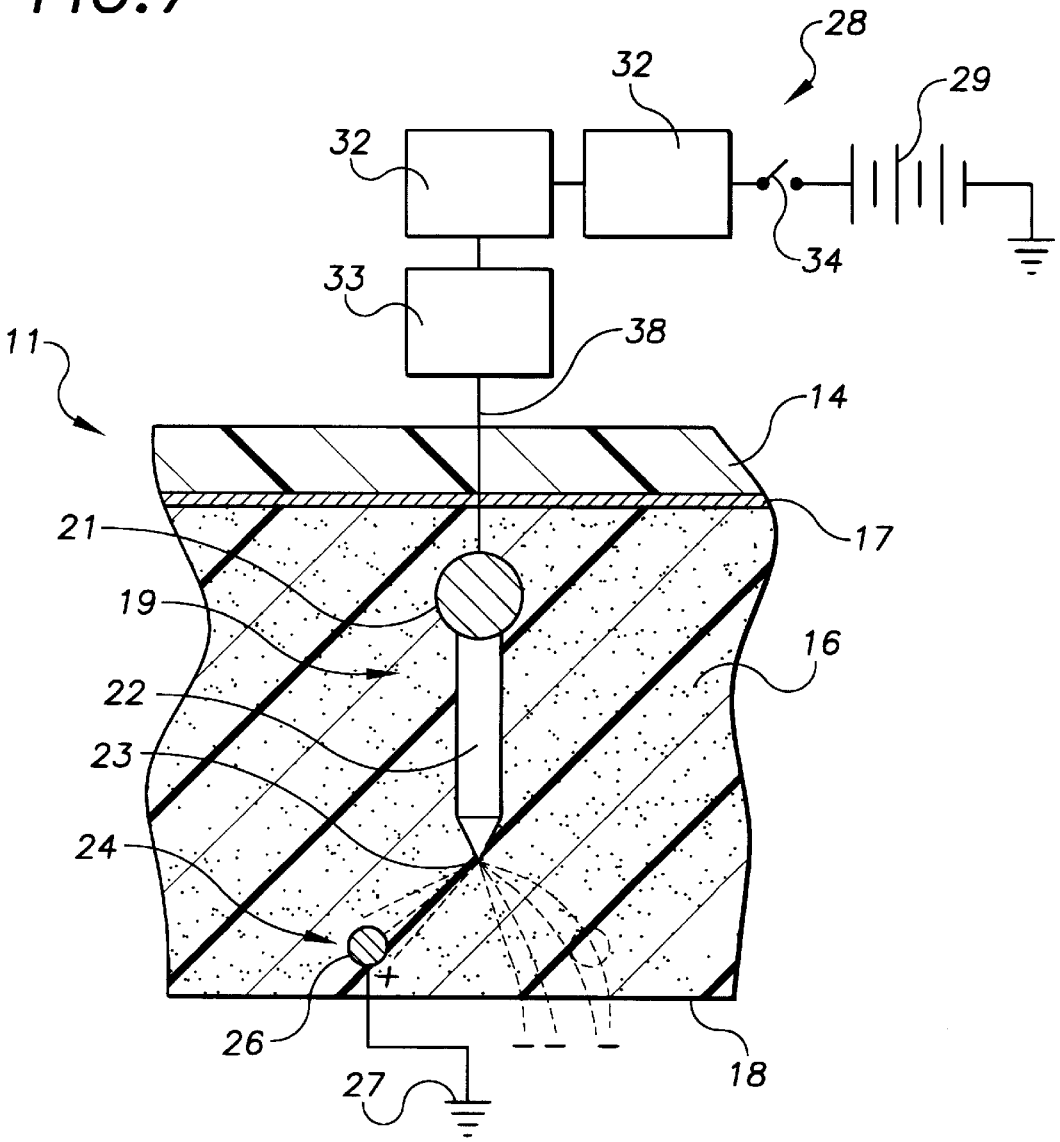
FIG. 7 is a diagrammatic view of the particle collector and its power supply.
Figure 6:
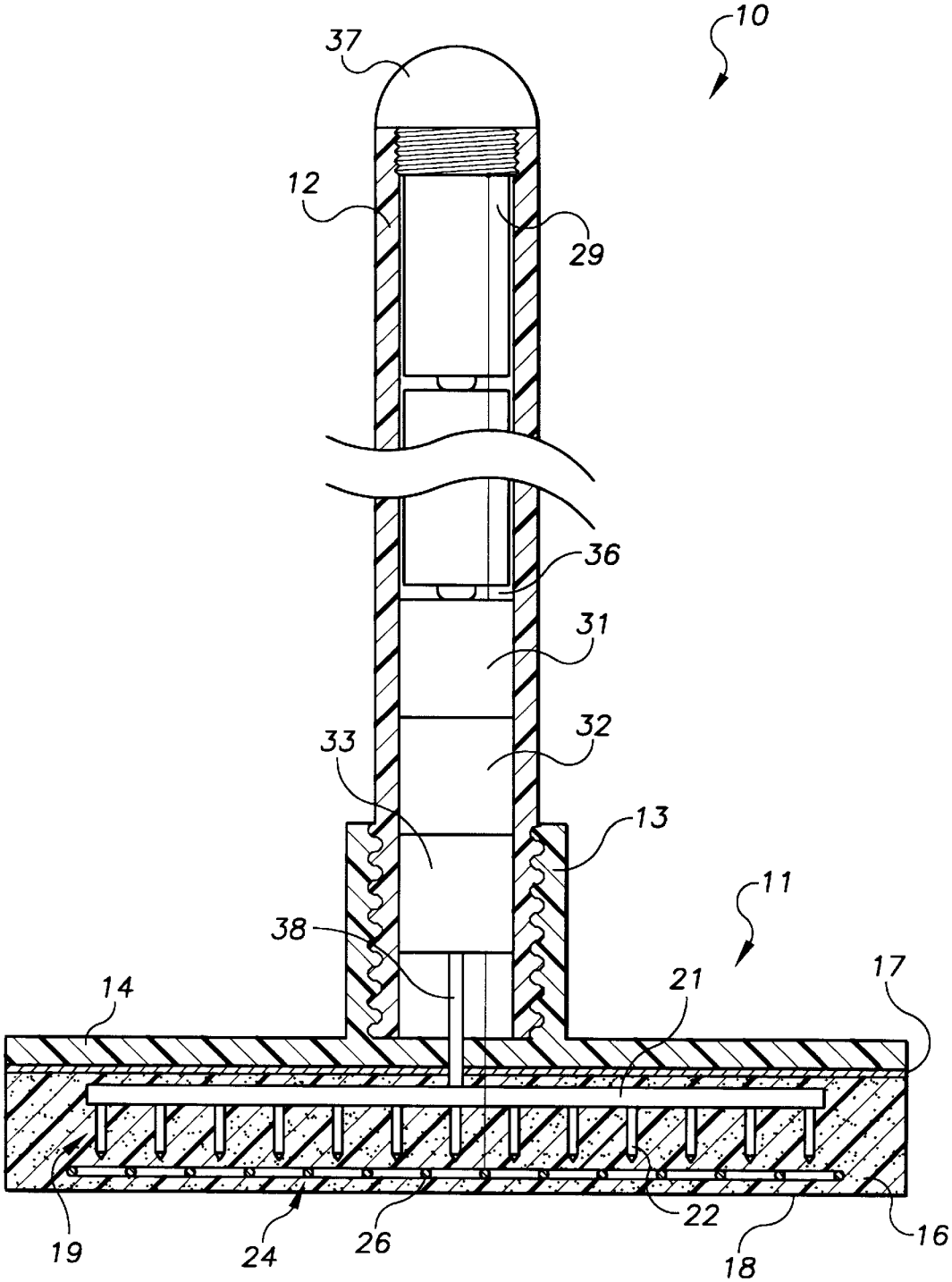
FIG. 6 is a sectional view taken along the line 6—6 of FIG. 2.

As shown in FIGS. 5, 6 and 7, a cathode 19 and anode 24 located within bar member 16 generate an electrical field. Cathode 19 generates negative charges or negative ions on the particles, such as dust, aerosols, bacteria, viruses, pollens, mold spores, animal dander, dust mites, allergens, and other particulate materials, that are collected on bar member 16. The anode 24 generates positive charges that attract the negatively charged particles which are collected on and within the bar member 16.

As shown in FIG. 6, cathode 19 has a longitudinal bar 21 supporting a number of tines or fingers 22. Fingers 22 are cylindrical members laterally spaced from each other and terminate in lower pointed ends 23. Ends 23 are located above bottom surface 18. The entire cathode 19 is located within the confines of bar member 16.

Anode 24 comprises a longitudinal conductor or metal rod 26 laterally spaced and below fingers 22. Anode 24 can have different shapes, such as a flat metal bar or a number of longitudinal metal rods. Rod 26 is connected to ground 27.

As shown in FIGS. 6 and 7, a static electric field is provided with a power supply 28 located within chamber 36 of handle 12. A cap 37 threaded into the top end of handle 12 closes chamber 36 to confine the power supply to chamber 36. Power supply 28 includes a battery 29 electrically coupled to an invertor 31 through a manually operated on-off switch 34. Invertor 31 is connected to a step-up transformer 32 electrically joined to a rectifier 33. A conductor 38 joins rectifier 33 to cathode bar 21. The voltage output of power supply 28 can vary in accordance with the requirements of the particle collecting process. Other types of power supplies can be used to provide the electric energy required to charge the particles and collect the charged particles.

In use collector 10 is energized by manually closing switch 34 located on handle 12. Battery 29 electrically activates the circuits of the power supply to cause cathode 19 to generate an electrical field that imparts a negative charge on particles below bar member 16. Bar member 16 is laterally moved relative to a surface or object to charge or ionize the particles. When the anode 24 passes over the charged particles they are electrically attracted to bar member 16 which has a positive charge. The particles are collected on bar member 16. The particles are removed from bar member 16 with a liquid, such as water, and disposed of in an environmentally compatible manner.

Collector 10 can also be used in dusting and vacuum systems, and air circulation, heating and cooling systems. For example, collector 10 can be associated with a vacuum system having source of vacuum supply operable to pull or move particles adjacent bar member 16 to ionize or charge the particles entering the vacuum and collect the charged particles escaping the vacuum system. Also, one or more collectors 10 can be mounted on or adjacent to the vanes radiating from a hub of a conventional fan device. When the vanes are rotated air containing airborne particles is moved by the vanes adjacent bar member 16 whereby the airborne particles moved by the fan vanes are ionized and collected by collector 10. Similarly, collector 10 can used in conventional space heating and cooling systems to charge airborne particles and collect the charged particles. Collector 10 is located in close proximity to the current of air moving through the heating/cooling system. Collector 10 ionizes airborne particles moving in the air current and collects the charged particles thereby removing undesirable particles from the environment.

The present disclosure is a preferred embodiment of the particle collector. It is understood that the particle collector is not to be limited to the specific constructions and arrangements shown and described. It is understood that changes in parts, materials, arrangement and locations of structures may be made without departing from the invention. The invention is defined in the following claims.

What is claimed is:

1. An apparatus for collecting particles from a surface or object containing particles comprising: a particle pick-up assembly including a cross head and a non-electrical conductor member mounted on the cross head, handle means secured to the cross head to facilitate manual movement of the particle pick-up assembly relative to the surface or object, first means associated with the non-electrical conductor member for imparting negative electrical charges on the particles upon movement of the particle pick-up assembly relative to the surface or object, second means associated with the non-electric conductor member for collecting the charged particles, the first means including a bar and a plurality of fingers joined to the bar, said fingers being laterally spaced from each other and extended downwardly into the non-electrical conductor member, and electric power means for supplying electric power to said first and second means.

2. The apparatus of claim 1 wherein: the non-electrical conductor member is a foam plastic.

3. The apparatus of claim 2 including: means securing the foam plastic to the cross head.

4. The apparatus of claim 1 wherein: said handle means includes chamber means for accommodating the electric power means.

5. The apparatus of claim 4 including: switch means mounted on the handle means operable to selectively activate and deactivate the electric power means.

6. The apparatus of claim 1 wherein: the first means is a cathode and the second means is an anode.

7. The apparatus of claim 1 wherein: the second means includes at least one rod spaced from the bar and fingers.

8. An apparatus for collecting particles from a surface or object containing particles comprising: a particle pick-up assembly including a cross head and a non-electrical conductor member mounted on the cross head, handle means secured to the cross head to facilitate manual movement of the particle pick-up assembly relative to the surface or object, said particle pick-up assembly having first means operable to impart negative electrical charges on the particles, the first means including a bar and a plurality of fingers joined to the bar, said fingers being laterally spaced from each other and extended downwardly into the non-electrical conductor member, and second means operable to collect the charged particles, said second means including rod means within the non-electrical conductor member spaced from the bar and fingers, and electric power means for supplying electric power to the first and second means.

9. The apparatus of claim 8 wherein: said handle means includes chamber means for accommodating the electric power means.

10. The apparatus of claim 9 including: switch means mounted on the handle means operable to selectively activate and deactivate the electric power means.

11. The apparatus of claim 8 wherein: the first means is a cathode and the second means is an anode.

12. An apparatus for collecting particles comprising: a particle collection assembly having a cross head and a non-electrical conductor member mounted on the cross head, said particle collection assembly having first means operable to ionize the particles, and second means operable to collect the ionized particles, and electric power means for supplying electric power to the first and second means, the first means including a bar and a plurality of laterally spaced fingers mounted on the bar, said fingers extended downwardly into the non-electrical conductor member, and said second means including rod means within the non-electrical conductor member spaced from the bar and fingers.

13. The apparatus of claim 12 wherein: the first means is a cathode and the second means is an anode.

* * * * *